US005791515A

United States Patent [19]

Khan et al.

[11] Patent Number: 5,791,515

[45] Date of Patent: Aug. 11, 1998

[54] ONE AT A TIME PILL/MEDICATION DISPENSER

[76] Inventors: Shaan Y. Khan, 3 Maple Way, Woodbury, N.Y. 11797; Matthew Curtin, 497 Sleepy Hollow Dr., Shirley, N.Y. 11967; Hernan Morales, #1 Sharp St., Patchogue, N.Y. 11722

[21] Appl. No.: 707,735

[22] Filed: Sep. 4, 1996

[51] Int. Cl.[6] ..... A47F 1/04

[52] U.S. Cl. ..... 221/154; 221/203; 221/265; 206/533; 215/237

[58] Field of Search ..... 221/135, 154, 221/203, 263, 265, 289; 206/533, 538, 539, 540; 215/223, 237

[56] References Cited

U.S. PATENT DOCUMENTS

| | | | |
|---|---|---|---|
| 2,824,667 | 2/1958 | Barnett . | |
| 3,241,712 | 3/1966 | Sacchetti et al. | 221/265 |
| 3,516,536 | 6/1970 | Kisaburo Ino | 215/540 |
| 3,610,466 | 10/1971 | Raybois | 221/135 |
| 3,874,564 | 4/1975 | Huneke | 221/266 |
| 3,896,967 | 7/1975 | Doolittle . | |
| 4,084,726 | 4/1978 | Nicol . | |
| 4,595,123 | 6/1986 | Libit | 215/237 |
| 4,782,980 | 11/1988 | Heimlich et al. | 221/203 |
| 5,040,691 | 8/1991 | Hayes et al. | 215/237 |
| 5,085,331 | 2/1992 | Groya et al. | 215/237 |
| 5,108,006 | 4/1992 | Ticke . | |

FOREIGN PATENT DOCUMENTS

| | | | |
|---|---|---|---|
| 2396697 | 3/1979 | France | 206/540 |
| 2625982 | 7/1989 | France | 221/265 |
| WO 91/17103 | 11/1991 | WIPO . | |

*Primary Examiner*—Karen M. Young
*Assistant Examiner*—Thuy V. Tran
*Attorney, Agent, or Firm*—Levisohn, Lerner, Berger & Langsam

[57] ABSTRACT

A one-at-a-time pill container and dispenser having a mechanism which allows for use of the device with existing containers. A child-proof lock is provided. The device has a mechanism for ensuring that only a single pill is brought into the dispensing chamber as a consequence of a partial rotation of the cap with respect to the bottle body. A reverse partial rotation of the cap then allows the pill to fall by gravity into the user's hand. The two-directional rotation to cause pill dispensing is easy for an adult but highly unlikely to be accidentally duplicated by a child. The mechanism is a series of wedge shaped chambers, sized for the capsule to be dispensed, with a covering flange over the dispensing chamber, to ensure that only a single capsule enters the dispensing aperture. The chambers are caused to be rotated by the mating engagement of the cap, via a pawl, with a segment shaped slot in the top of the dispensing mechanism.

15 Claims, 7 Drawing Sheets

FIG. 3
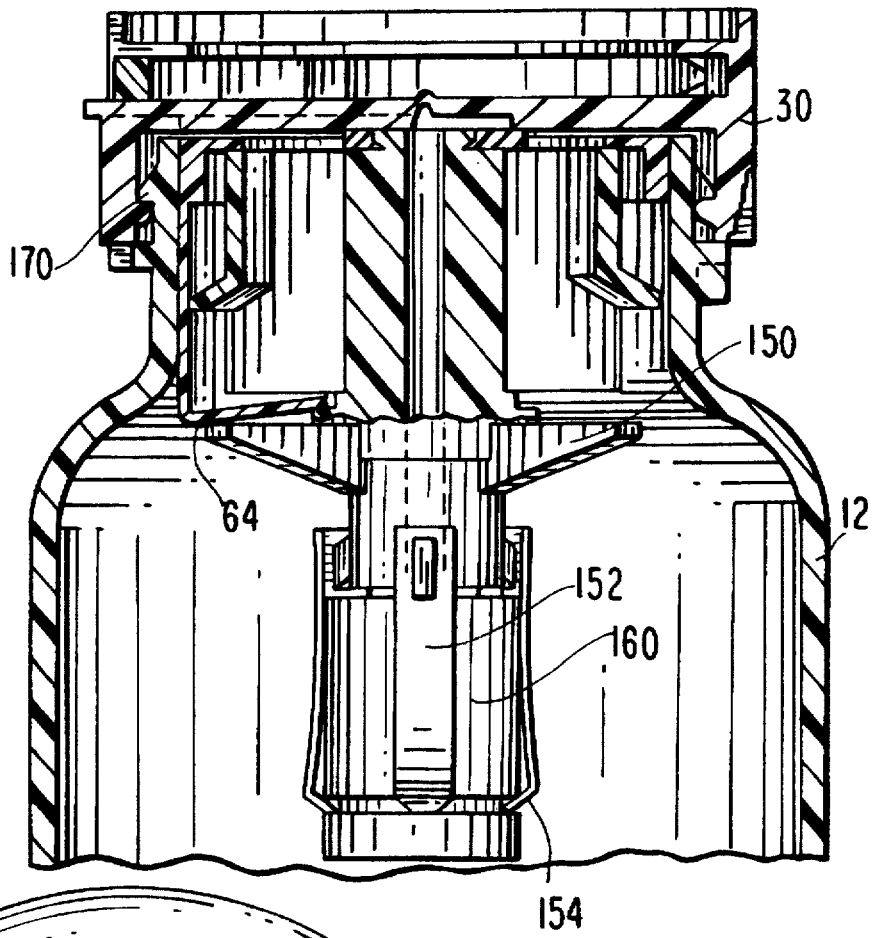
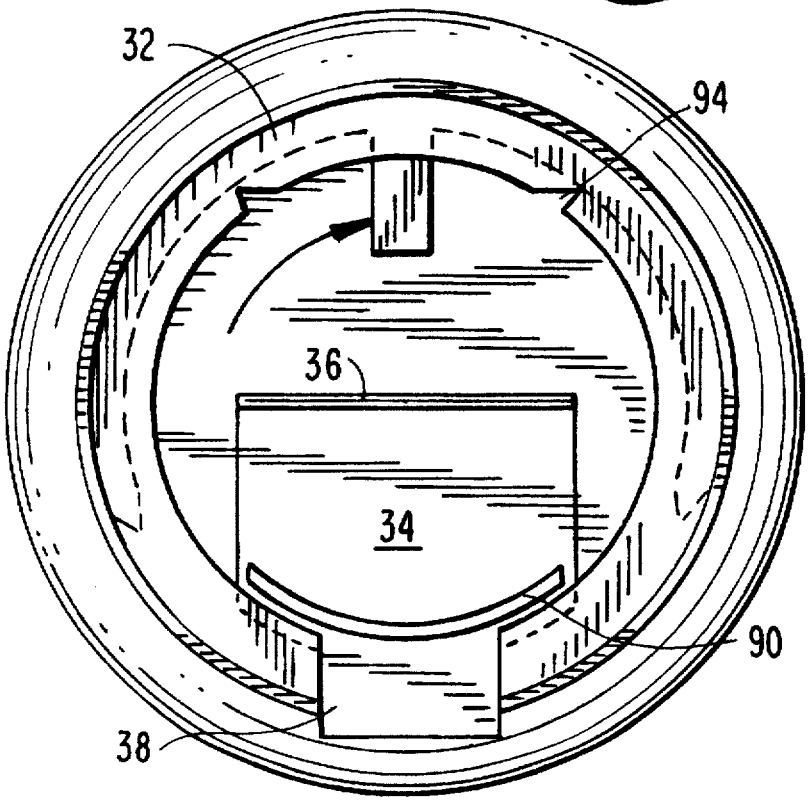
FIG. 4

FIG. 9
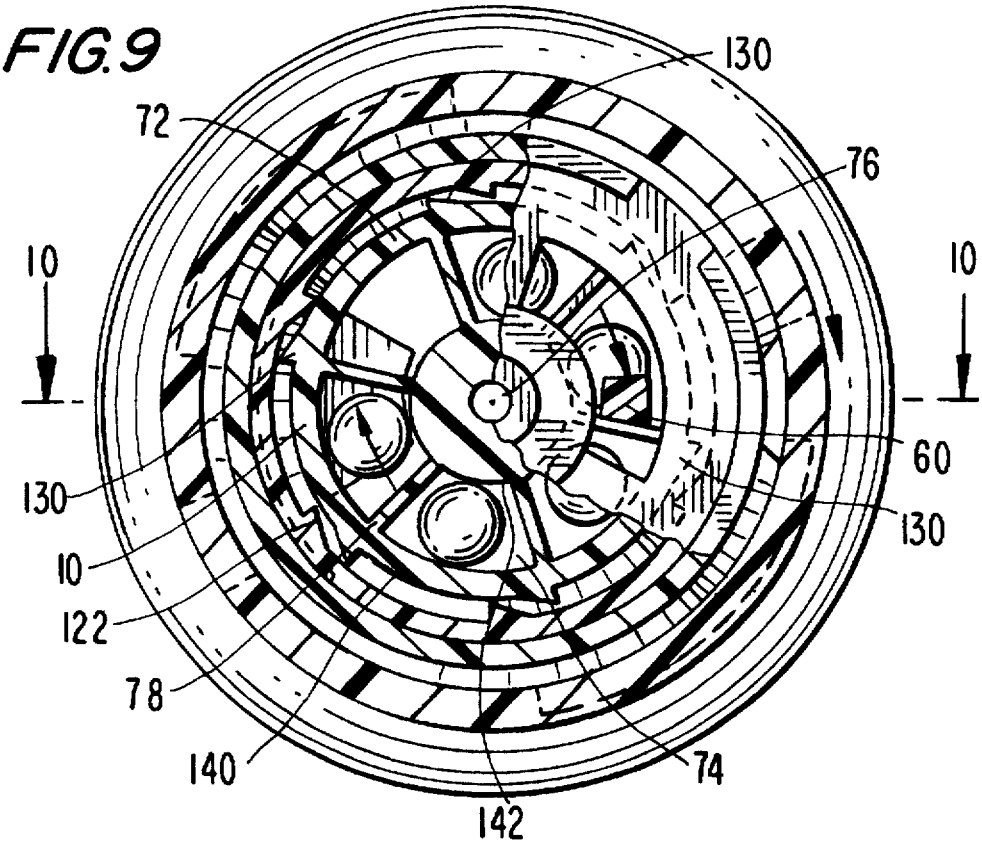
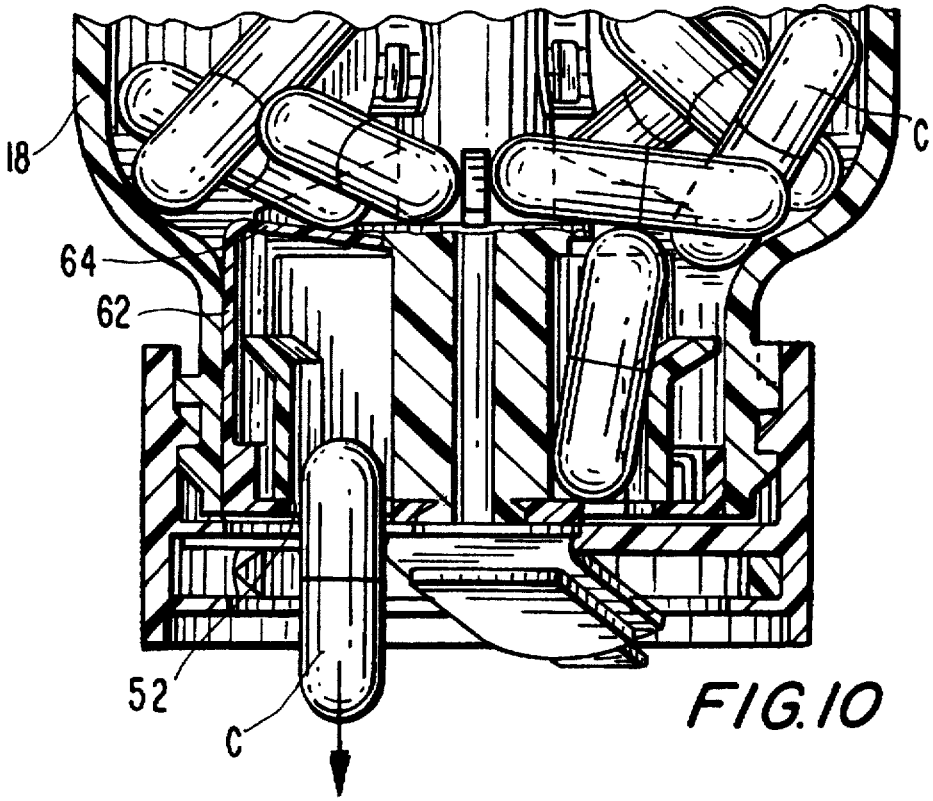
FIG. 10

FIG. 12
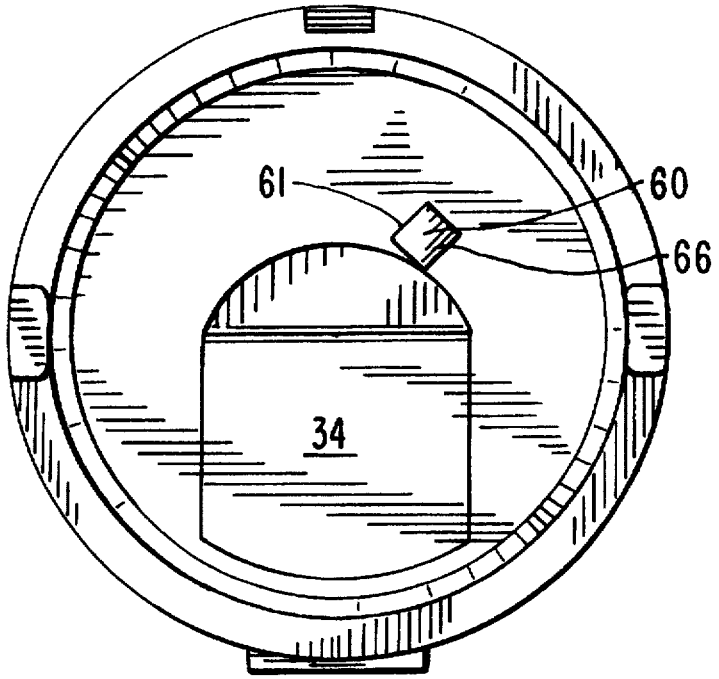
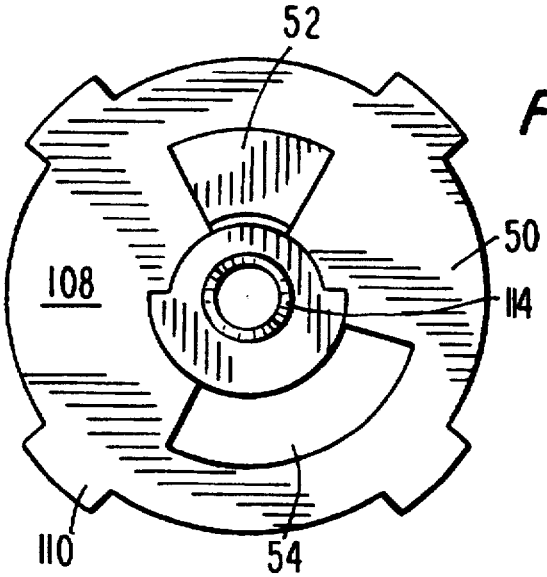
FIG. 13
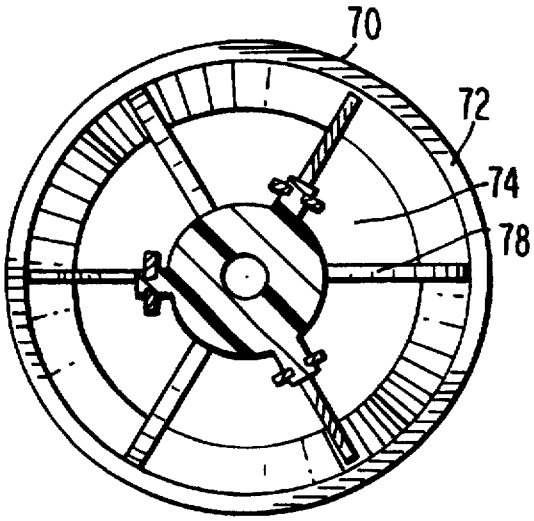
FIG. 14

ONE AT A TIME PILL/MEDICATION DISPENSER

BACKGROUND OF THE INVENTION

The present invention relates to the general field of capsule, tablet and caplet containers for dispensing by individuals. Generally speaking the capsule, pill, tablet and caplets (hereinafter for convenience collectively referred to as "capsules") are medicinal and intended for ingestion by a consumer to treat a medical related condition. The container will be initially provided with a large multiple of the capsules and the consumer will desirably dispense to himself or herself one of the capsules at a time. Even if more than one capsule is to be ingested at a time, the user will obtain the capsules from the bottle or container in a one-at-a-time fashion. Alternatively, of course, the present invention can be used as a device for being retrofitted to existing pill and capsule containers by removing the original "safety" cap and replacing it with the present mechanism. It should also be appreciated that the present device, in association with the bottle and the capsules, can be used by those personnel who have authority to dispense capsules to others. This one-at-a-time capsule dispensing facilitates the dispensing process. In many situations a bottle with multiple capsules is accessible to many individuals, as, for example, a bottle of aspirin capsules in an office with many workers. The present invention allows any of the workers to dispense to himself or herself a single capsule without his or her hands unnecessarily touching or coming into contact with the other capsules. Thus, the present invention provides the individual capsules in a more sterile manner than the prior art devices which allow a user to remove many capsules at once and then the individual replaces the excess (not-to-be ingested) capsules back into the bottle but only after his or her fingers have touched the same.

DESCRIPTION OF THE PRIOR ART

Capsule containers and dispensers have existed for quite some time. Generally, they comprise a bottle-like holding compartment with a removable cap. Often, and of recent, the caps have been provided with safety mechanisms so that children can not inadvertently or accidentally gain access to the capsules contained in the bottle. That, of course, could be very harmful to a young child, should he or she ingest one or more of the capsules. Many safety mechanisms have been developed over recent years, most requiring two or more discrete and sequential hand movements to gain access to the inside of the bottle so as to obtain a capsule. For example, a very common safety mechanism incorporated into commercially available capsule dispensers today requires the simultaneous pushing down on the cap of the device while turning the cap so as to cause alignment of portions, thereby allowing the cap to be removed. However, with the known prior art devices, the removal of the cap provides access to all of the interior contents. Thus, a child who even accidentally "figures" out the method of gaining access to the interior of the bottle or, also possible, a "grown-up" who disables the safety mechanism because of the dexterity required to overcome it (which is often difficult for many, especially arthritic persons) unavoidable provides a potentially dangerous implement to a child, a bottle with medication containing a plurality of capsules.

The present invention allows access to the interior contents of a medicine holder, a capsule container, but only on a one at a time basis. Thus, for example, even if a child were to accidentally "figure" out the method of dispensing the capsule from the bottle, only a single pill would be dispensed. In contrast, as mentioned, when a child "figures" out the prior art safety mechanisms and overrides the same, the child gains access to the entire contents of the bottle.

A device is now commercially available for holding coffee sweeteners until the user desirably dispenses the same. The device dispenses capsules by the simple reciprocation of a side button. Pushing the button inwardly causes a slide mechanism to push a capsule through an opening and simultaneously another capsule is loaded into the pushing chamber, ready for dispensing when the side button is reciprocated again. The activation of the dispensing mechanism is extremely simple and is intended to be simple. There is no "safety" aspect to this prior art device. Indeed, a child, without much effort, can easily dispense one or all of the contents of this container. In contrast, the present invention requires complicated manual movements, i.e., complicated for a child, for the selective dispensing of a single capsule. Thus, a child-proof one capsule at a time dispenser is presented which, even if a single capsule is dispensed by the movements of the child, is not likely to be replicated by the child. Safety is thus promoted.

International Publication No. WO 91/17103 by the Procter-Syntex Health Products Company, published 14 Nov. 1991 by the International Bureau of WIPO, shows a tablet dispenser with a locking means. The device shown therein is also the subject of issued U.S. Pat. No. 5,108,006 issued Apr. 28, 1992. The device shown relates to a dispensing container for tablets. It is an attempt, too, to eliminate the tendency of dispensers to inadvertently dispense tablets and to decrease accessibility of the tablets to children. The disclosed container comprises a housing, a reciprocating element, and a locking mechanism. The locking mechanism locks and unlocks the reciprocating element.

To operate the tablet dispenser of the identified U.S. patent, the locking means is first turned to the unlocked position if it is not already in that position. The unlocked position is detectable by tactile, visual and auditory indicators. The dispensing cycle begins with the reciprocating means in the position shown in FIG. 7 thereof. The tablets are resting in the guide path created by the various surfaces. FIG. 8 shows the container shortly after the dispensing cycle begins. As the cycle begins, by reciprocating the element 26, the lowermost tablet within the container is directed into the tablet accommodating means of the reciprocating element by surface 46. Surface 87 nears surface 46 creating a choke point, i.e., a point of sufficiently small diameter that another tablet cannot enter until the first is dispensed. Further relative movement of the reciprocating means of the dispenser of the '006 patent causes the lowermost tablet to roll out of the tablet accommodating means. This results in the tablet being dispensed. A biasing mechanism ensures that the reciprocating element return upwardly with respect to the container, readying the components for another cycle and allowing a second tablet to enter the tablet accommodating means. To summarize then, although a more complete description of the elements and manner of operation can be obtained by specific reference to the '006 patent, a downward pushing of the "push button" on the top of the dispenser causes a pill to pass between two surfaces which move relative to one another, with more than one tablet blocked from dispensing by the geometry of the surfaces and elements. In contrast, the present invention, provides, as more fully explained hereinafter, a rotation in a first and then opposite direction of the cap (after unlocking a safety mechanism by rotation of the same)to dispense a single tablet. The device of the '006 patent, once the device is in its unlocked position, is rather easy for a child to dispense a first, second and a plurality of tablets by the simple and natural act of pushing down on the top, which returns by the biasing mechanism to its original position. Thus accidentally leaving the device of the '006 patent in its unlocked position is potentially dangerous for it may lead to tablet dispensing. In contrast, the present invention requires, even after the device is first placed in its unlocked position, an upside down movement followed by relative rotation of the cap in a first direction and then a relative rotation of the cap in the opposite or in the second direction. This is not a "natural-"movement and, therefore, a child is not likely to gain access to all contained tablets, even if the device is in its unlocked position. This is a significant safety advantage.

The device of the '006 patent does not appear to be airtight. When the reciprocating button returns to its original position, there does not appear to be a proper sealing such that air may easily pass into the storage compartment. This is sought to be avoided by the invention disclosed herein. Furthermore, the present invention teaches the use of an absorbent canister for moisture. The positioning of that feature such that it will not cause the one-at-a-time dispenser to jam is an important aspect of the present invention. Loose cotton may jam or disrupt the pill movement in the device of the '006 patent. Furthermore, the device of '006 is based on a substantially new holding container and moving components, making it very expensive to manufacture because new dies would be required. In contrast, the present invention contemplates that the holding or storage compartment be substantially the same bottle as existent in the prior art such that only the cap and its associated components need to be manufactured anew. Minor changes to the neck of the bottle, if any, are required.

U.S. Pat. No. 2,824,667 to Barnett, issued Feb. 25, 1958 relates to a portable combination container and dispenser. A series of vertically stacked tablets can be dispensed one at a time by the downward movement of the button. Again, there is a vertical upward bias to the button so that, after a first dispensing, the device can very simply be caused to dispense another tablet, merely by pushing on the button. This, then, suffers from similar disadvantages as the previously discussed '006 patent. Of course, it should also be understood that the storage capacity of the device shown in the '667 patent, requiring vertical alignment of tablets, is far less than a random stacking of the tablets in a round bottle. This, too, represents an improvement of the present invention over the prior art. This device, too, like that of the '006 patent, does not appear to provide an airtight container for the long term holding of capsules. The present invention substantially provides an airtight holding chamber. The device of the '667 patent does not provide a moisture absorbent device. Also, the pills of the present invention are free to move such that random selection is ensured. The device of the '667 patent requires pre-alignment of the pills prior to selective dispensing.

U.S. Pat. No. 3,896,967 to Doolittle, issued Jul. 29, 1975, is for an article handling apparatus and method. It shows a device for dispensing tablets, one at a time, by manual manipulation of the receiver 12, by the knurls 56. This device, too, requires the prealignment of the tablets and, therefore, is not efficient for storage of a large number of tablets. In contrast, the present invention allows for a manufacturer to fill a bottle with a large number of tablets, in conventional manner by machine, without aligning of the tablets in one or two lines. The present invention is far more efficient in terms of storage of a large number of tablets for later dispensing one-at-a-time.

U.S. Pat. No. 4,084,726 shows a seed dispenser. It issued to Nicol on Apr. 18, 1978. The device allows a large number of seeds to be stored in the central bottle or container portion, in a random manner. The dispensing of a seed occurs by the manual reciprocation of the button, against the force of a spring. Again, after dispensing a seed, like a tablet, the button is placed into a position, ready for dispensing a second seed by the mere downward pushing of the button. The spring bias of the button allows for repeated, rapid dispensing of seeds, one after another. The present invention, on the other hand, has no automatic bias into a ready for dispensing position. Rather, as mentioned, a relative rotation of the device's cap with respect to the holding bottle is required in a first and then a second direction. This is a far more complicated task for a child than the mere downward reciprocation of a button so that a child who has been provided with access to the dispensing mechanism as, for example, by the user forgetting to replace the safety lock mechanism into the lock position, will not be easily provided with access to all of the bottle's contents. The prior art is deficient in this respect.

SUMMARY OF THE INVENTION

It is an object of the present invention to provide a container or bottle for capsules, tablets, pills, etc. (hereinafter collectively referred to as "capsules") which allows for the efficient storage of large numbers and, yet, the storage container is provided with a mechanism for dispensing one capsule at a time. It is a further object of the present invention to provide a storage container or bottle for capsules which allow the capsules to be placed into the storage area in a random manner. Even though stored in this random manner, the present invention provides a one-at-a-time capsule dispensing.

It is also an object of the present invention to provide a one-at-a-time capsule dispenser which is inexpensive to manufacture and which can be made as a retrofit cap to existing bottles and containers, with minimum changes to the bottles, and, in addition, which can be an entirely new article of manufacture.

It is an object of the present invention to provide a one-at-a-time capsule dispenser which is easy for adults and authorized users to dispense capsules and, yet, even with the child safety mechanism in an unlocked position or condition, requires some not insignificant degree of manual dexterity, to dispense one or more capsules.

It is an object of the present invention to provide a capsule dispenser with a safety mechanism which requires adult-like manual dexterity to override so that the overall medication container is childproof. It is also an object of the present invention that even if the childproof safety mechanism is in its unlocked position, access to one or more of the capsules within the storage chamber is blocked by the not insignificant relative rotational dexterity required, in two opposite directions, in order to dispense a single capsule.

It is clearly one of the principal objects of the present invention to provide an inexpensive yet reliable one-at-a-time capsule dispenser. In this manner, an individual who needs to "take" one or two capsules, for example, will not unnecessarily touch the other capsules within the container. More specifically, for example, in an office environment, a single large capacity bottle of aspirin or headache relief capsules can be found. One individual needing one or two capsules should not come into contact, for hygienic reasons, with more than the number of capsules he or she needs for that medication need. Yet, according to the headache-relief containers, now on the market, the individual will open the bottle, pour many such capsules into his hand, take one or two orally, and then funnel the balance back into the bottle for someone else's use. This, clearly, is not hygienic. The present invention provides a container for a large number of capsules, allows them to be randomly stored in the storage container for space efficient purposes, and yet allows only the number of dosages of capsules to be dispensed as are required at that particular time. This is very hygienic and desirable.

It is an object of the present invention to provide a capsule container intended for one-at-a-time capsule dispensing which substantially uses the capsule container or storage portion of existing capsule bottles. This reduces the expense involved in implementing the present invention into the marketplace. Thus, the storage chamber of the present invention is substantially the same as that previously used by commercial medication manufacturers.

It is another object of the present invention to provide a capsule or medication dispensing device which is childproof and yet relatively easy for an adult to use. The ease of use by an adult, however, is via a mechanism which is not "natural" for dispensing so that a child who gains access to the device with the child locking mechanism in the unlocked position will not gain access to the entirety of the contents of the bottle. It is a further object of the present invention to provide a medication dispenser with a childproof locking mechanism, separate from the capsule or pill dispensing mechanism. Changing the device from its locked to its unlocked, capsule dispensing condition, is a task requiring the manual dexterity of an adult.

It is also an object of the present invention to provide a totally plastic construction for medication storage and one-at-a-time capsule dispensing. The use of plastic makes the device capable of easy mass manufacturing at a minimum cost. Also, the use of plastic components allows for an air tight construction, desirable in the storage of capsules. It is an object of the present invention to provide a storage container for medication capsules wherein the holding chamber is large enough to store a large number of capsules, in random packing, and yet the storage chamber is large enough to also house an absorbing medium for moisture.

It is also an object of the present invention to provide a medication storage and dispensing device which is operable primarily by full hand manipulation, i.e., the use or individual finger movements is minimized. This provides less stress on elderly patients and users and even those of younger age who may suffer from arthritic conditions. The dispensing of capsules, once the child proof lock is disabled, is by gripping the cap in one hand and the bottle portion in the other hand and by relative quarter-turning of the two in a first and then a second direction. Individual finger movements are reduced if not entirely eliminated.

It is also an object of the present invention to provide a capsule dispensing container with the above features and which accomplishes the aforementioned objectives at relative minimal costs.

The components of the present invention provide vibration to the contained capsules such that as one capsule is dispensed, the internal capsules are mixed, leading to capsules falling into any of the empty chambers for subsequent dispensing. The second "stroke" of the dispensing cycle, i.e., when the cap is rotated clockwise to dispense a capsule causes the pawl of the cap to push against the edge of the walls of the wheel-like component and to deflect the holding plate from its horizontal orientation. Once the pawl is through with its cycle, the snapping of it into position, ready to turn the next chamber of the wheel-like component (by interengagement with an edge of a wall of a chamber), causes a shaking or vibration of the capsules within the chamber. This facilitates the mixing of the capsules such that they will fall into any empty chambers. The wheel-like component is attached to the holding plate. Once the wheel-like component is pushed by the pawl, the holding plate flexes and then snaps back into its non-flexed position, after the pawl passes under the wheel-like component. This causes the vibration.

Sweeping blades of the present invention, too, facilitate the mixing and alignment of capsules with any empty chambers for subsequent, one-at-a-time dispensing. The sweeping blades push the capsules, too, downwardly, i.e., when the cap is directed downwardly, to help the dispensing process.

SUMMARY OF THE INVENTION

In accordance with the present invention, a capsule storage container is provided with a child proof locking mechanism. The child proof locking mechanism requires two separate mechanical operations to disable. After placing the locking ring segment, the child proof mechanism, into its unlocked position and opening the door of the cap to its open position, rotating the door about a plastic hinge, the device is capable of dispensing capsules, one at a time. Grasping, with the cap down, the bottle in one hand and the cap in the other hand and rotating the two relative to one another in a first and then second direction, causes a single capsule to be dispensed into the user's hand. An additional rotation in a first and then second direction of cap with respect to bottle will cause a single, now second, capsule to be dispensed, and so on. The device is relatively simple, plastic, compact and reliable. After the required number of capsules have been dispensed, the user can, if desired, relock the device to put it into the child proof mode. Alternatively, of course, if no children are present in the environment, the user can permanently disable the child proof feature.

Basically, the child proof mechanism comprises a ring segment which is contained beneath a lip of the cap. With the ring overlying the door of the cap, the cap cannot be rotated about its hinge to the open position. Only after the ring segment is rotated so that its opening is aligned with the door's tab, can the door be hinged to open. The door is locked in the open position by the cooperation of the door's ring-like segment (which serves to maintain the ring segment in place) with a pair of notches in the cap.

Inside of the bottle are, of course, a plurality of capsules. They, of course, form no part of the present invention. They are the object of the present invention, i.e., they are meant to be stored in the bottle portion until needed for dispensing and, via the internal mechanism of the invention, the capsules are to be dispensed one at a time. Although more details follow of the construction of the invention, basically, the device comprises a holding plate having an arcuate shaped hole in dimension substantially corresponding to the width of a capsule. For purposes of the description of the present invention, the invention is described in connection with capsules which have a length greater than their width, although the device can be dimensioned, of course, to accommodate all sizes and shapes of capsules. The present invention can be designed and modified so as to accommodate a wide variety of capsule shapes and sizes. The arcuate single-capsule hole of the holding plate sits basically across from a larger arcuate slot. This slot is the access window for a pawl (located beneath the cap of the device) to cooperate and turn the internal pie-shaped chambers, each carrying a single capsule (unless there are so few capsules in the container to accomplish this). The pie-shaped chambers are rotated so that one with a capsule is aligned with the single-capsule hole of the holding plate. The capsule can thus pass from the pie-shaped chamber, through the single-capsule hole and then through the opening in the cap provided by the open door.

Relative rotational movement between the cap and the bottle or holding portion of the device stirs the other capsules so that it is likely that one of them will fall into the now empty pie-shaped chamber. Relative rotational movement, as described, causes a single capsule to be dispensed. An extension of the holding plate wraps around the pie-shaped chambers as a ceiling or limiting flange so that only one capsule can be in the dispensing chamber, through the single-capsule hole in the holding plate and through the door at a time. The pie-shaped chambers, for the individual capsules, are provided with sweeping blades for facilitating the loading of capsules into the pie-shaped chambers. The sweeping blades also mix the contents of the container and cause the pills to adopt a variety of packed configurations so that all pie-shaped chambers are filled with capsules, at all times, to the extent that the container has sufficient capsules to do so. An absorbent canister can be axially aligned with the sweeping blades to absorb moisture and, yet, not interfere with the operation of the device.

BRIEF DESCRIPTION OF THE DRAWINGS

While the specification concludes with claims which particularly point out and distinctly claim the invention, it is believed the present invention will be better understood from the following description of the preferred embodiment taken in conjunction with the accompanying drawings, in which like reference numerals identify identical elements and wherein:

FIG. 3 is a partial side, cross-sectional view of the present invention, taken along lines 3—3 of FIG. 2;

FIG. 4 is a top plan view, substantially the same as FIG. 2, with the child proof mechanism, the ring segment, rotated to its open position;

FIG. 9 is another cross-sectional view of the invention with capsules, substantially similar to that show in FIG. 7, yet with the cap rotated relative to the bottle;

FIG. 10 is a partial cross-sectional view of the invention, in its open position, with a capsule falling, by gravity, from a pie-shaped chamber, through the single-capsule opening of the holding plate and through the opening in the cap; this view is taken along lines 10—10 of FIG. 9;

FIG. 12 is bottom plan view, taken along lines 12—12 of FIG. 11, and shows the bottom of the cap with the door in its closed position;

FIG. 13 is a top plan view of the holding plate of the invention, taken along lines 13—13 of FIG. 11; and FIG. 14 is a bottom plan view of the pie-shaped chamber device, taken along lines 14—14 of FIG. 11.

DETAILED DESCRIPTION OF THE DRAWINGS AND THE PREFERRED EMBODIMENT

Figure 1:
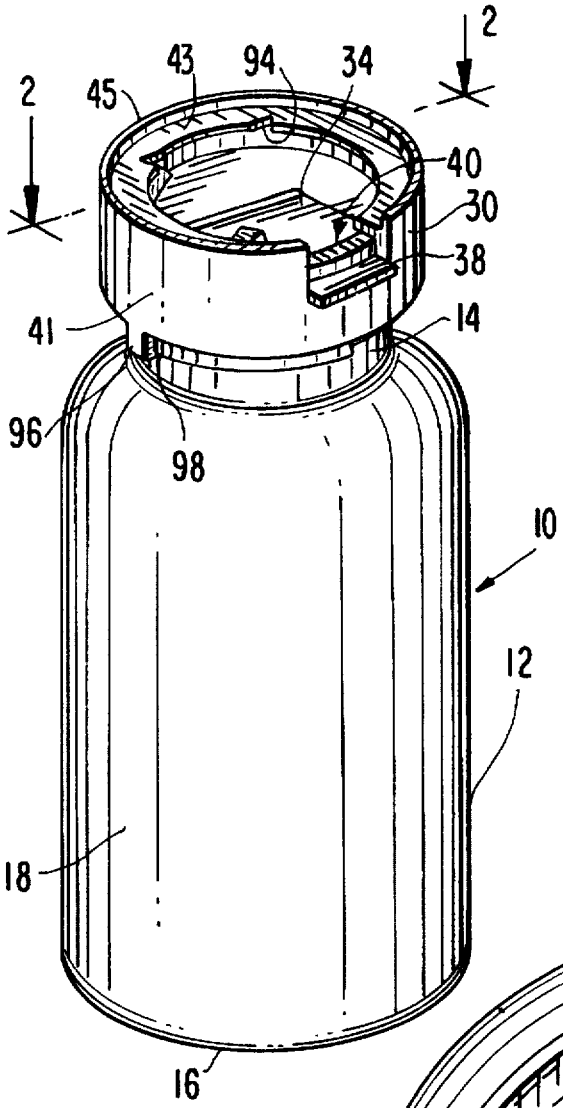
FIG. 1 is a top, front and left side perspective, assembled view of the present invention, showing the cap on a capsule containing bottle portion, with the device in its locked position.
Figure 2:
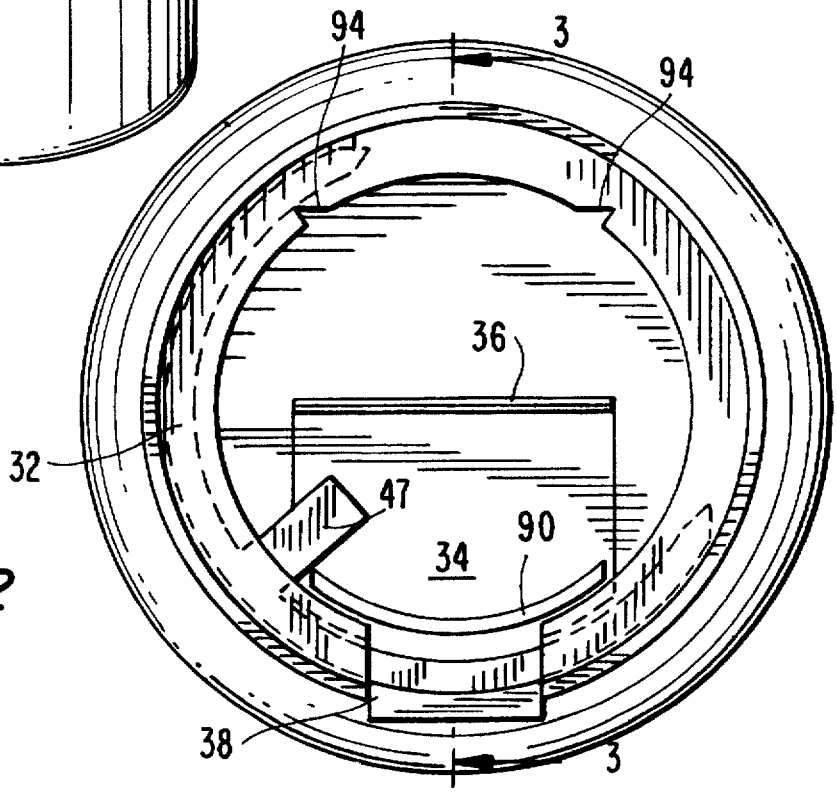
FIG. 2 is a top plan view, taken along lines 2—2 of FIG. 1 of the present invention, showing the child proof mechanism, the ring segment, in its locked position.
Figure 11:
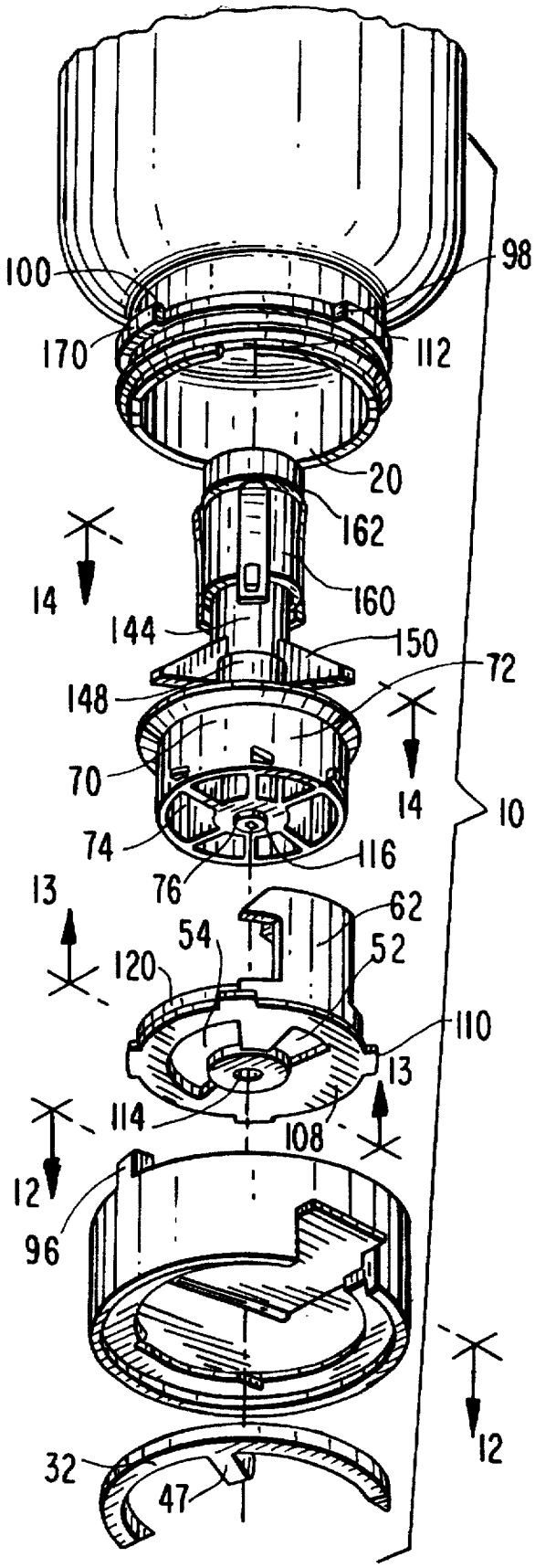
FIG. 11 is a partial, exploded view of the present invention, showing the bottle, on top, the pie-shaped chambers, with sweeping arms and absorbent can below, the holding plate (and its integral flange/ceiling for the pie-shaped chambers, the cap and the child proof locking ring segment.

As best seen in the Figures, and, in particular, FIGS. 1 and 11, the present invention, a capsule storage device and dispenser 10 comprises a capsule holding container or bottle 12 with a neck portion 14. The bottle is quite conventional in configuration and comprises a bottom 16, a cylindrical side wall 18 and a mouth 20 defined by the opening in the neck portion 14. Various sizes can be used for the present invention and, yet, the current preferred embodiment of the invention contemplates that the bottle 12 be capable of holding about 200 capsules, each of about 250 mg. The contained capsules "C" do not form a part of the present invention but are illustrated and drawn since the purpose of the invention is the storage and dispensing of capsules. Of course, the size and shape of the capsules can be varied, too, without departing from the scope of the invention. It is intended that all parts of the invention be molded from plastic as will be easily understood by those of ordinary skill in the art. The only exception to this would be the absorbent canister (to be described later) which may contain either a moisture absorbing material or cotton to prevent degradation of the contained capsules, over time.

Figure 5:
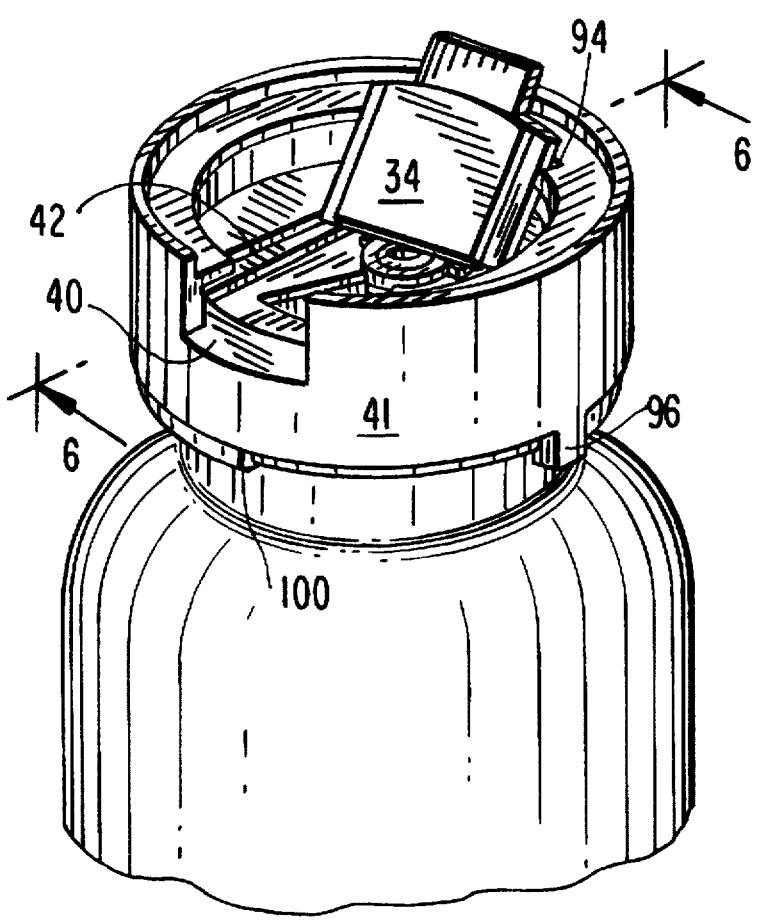
FIG. 5 is a top, partial perspective view of the present invention, shown rotated about 90 degrees from that of FIG. 1, with the door of the cap in its open position.
Figure 6:
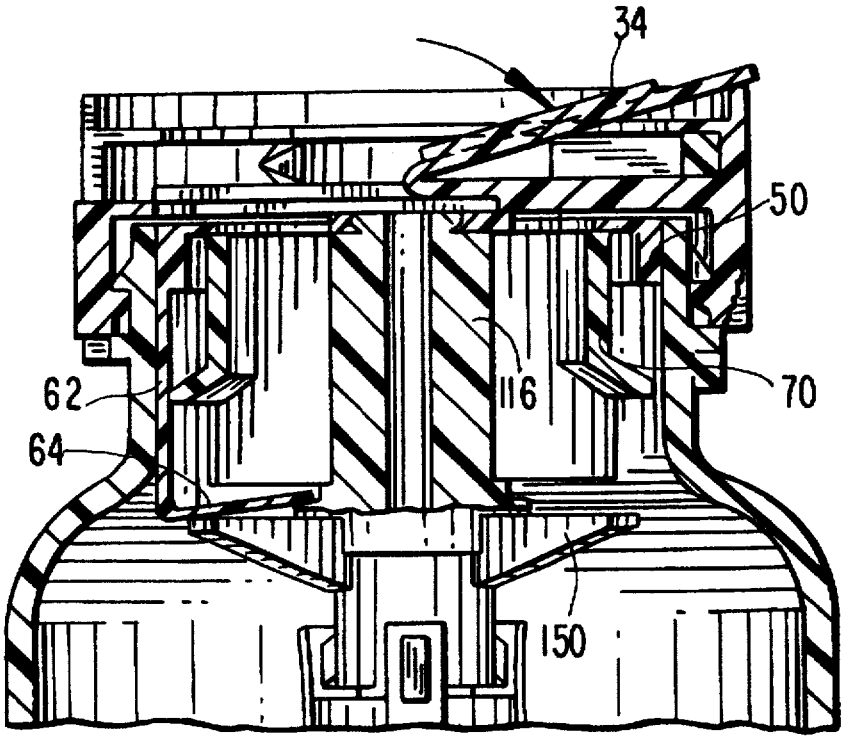
FIG. 6 is a partial, cross-sectional view of the invention, taken along lines 6—6 of FIG. 5, with the door of the cap flipped into the open position, i.e., after the ring segment has been rotated to its open condition (no longer child proof)

A cap 30 is secured to the neck portion 14 of the bottle 12 and covers the mouth 20 so that no appreciable air is allowed to enter the interior of the bottle unless the door to the cap is open. The cap is provided with a child proofing ring segment 32 and a hinged door 34, movable about a hinge 36, when tab 38 is lifted. The tab 38 can not be moved until and unless the ring segment 32 is moved such that its opening is aligned with the slot 40 (See FIG. 5) in the sidewall 41 of the cap. That frees the tab 38 so that it can lift and rotate the door 34 of the cap to its open position, thereby exposing the opening 42 of the cap.

Located beneath (when the bottle is in its storage, not dispensing position) the cap is the holding plate 50. It has two holes in its top surface. One hole 52 is an arcuate segment of only slightly greater width than the width of the capsules to be contained within the bottle. An opposed (but offset by 45 degrees) and larger arcuate segment or window 54 is also provided to the top of the holding plate 50. It serves as a window to provide access for a pawl 60 (beneath the cap, more fully described later) so that rotation of the cap 30, rotates the pawl 60, and in turn, the pawl extends through the window 54 of the holding plate 50 so that the pawl mechanically turns a pie-shaped chamber containing a capsule.

Attached to the relatively circular top surface of the holding plate 50 is a side flange 62. Extending radially inwardly from the side flange 62, and in a pie-shape is a ceiling 64 for the dispensing location of the pie-shaped chambers of the device. The ceiling 64 ensures that only a single capsule can pass through the hole 52 of the holding plate and then through the opening 42 of the cap, provided by moving the hinged door to its open position.

A wheel-like component 70 is comprised of a plurality of pie-shaped capsule holding chambers 74. The wheel-like component has a center hub 76 and a plurality of radially-outwardly extending walls 78. The outside circumferential wall 72 of the wheel-like component 70 is secured to the outside edges of the walls 78. Each of the holding chambers 74 are dimensioned in width to be just greater than the width of a capsule C to be contained with the bottle. In the preferred embodiment of the present invention, the wheel-like component 70 is provided with six equal, pie-shaped holding chambers 74 for the capsules C. The distance from the hub 76 of the wheel-like component to its outside circumferential wall 72 is a distance equal to the thickness of the capsules. Of course, if the capsules are cylindrical with rounded ends, the width between walls 78 a point adjacent the circumferential wall 72, defining the pie-shaped capsule holding chambers and the distance from the hub 76 of the wheel-like component 70 to the circumferential wall 72 are about equal. The point here is that a single capsule C can be held vertically in a pie-shaped holding chamber 74 and pass between the walls defined by the pie-shaped holding chambers when alignment is made between the hole or opening 52 in the holding plate 50 and the opening 42 of the cap.

Figure 7:
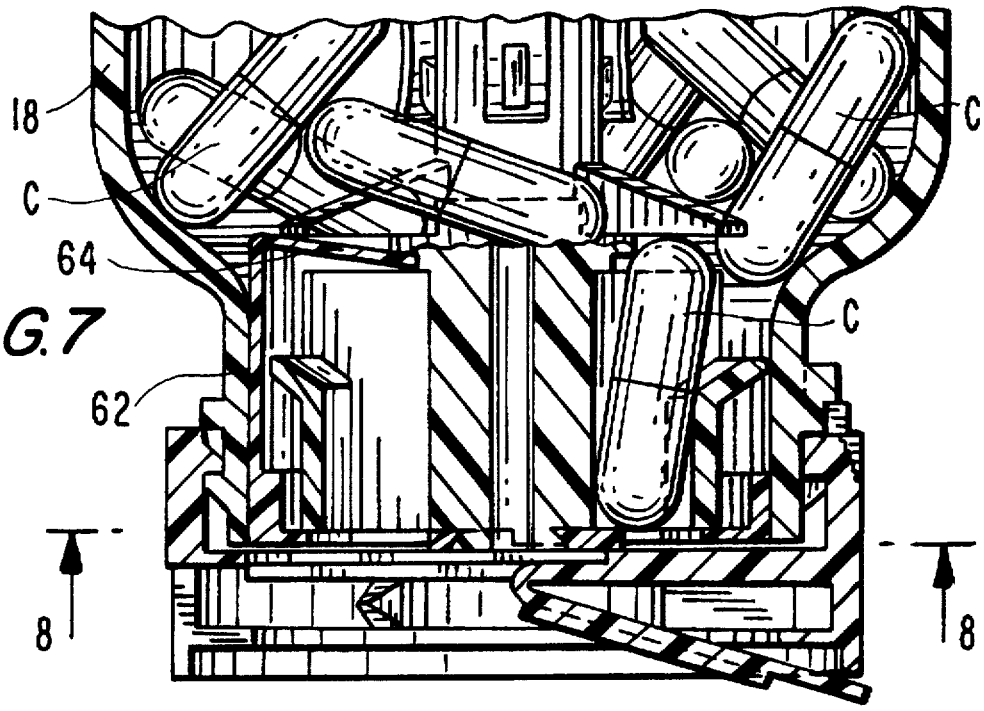
FIG. 7 is a partial cross sectional view of the invention, with the door of the cap in its open position, with the capsule containing or bottle portion inverter so that the cap is downward, i.e., the capsules are shown with one capsule in a pie-shaped holding chamber, ready to pass by gravity through the holding plate and the opening provided by hinged movement of the door to reveal the cap's opening.
Figure 8:
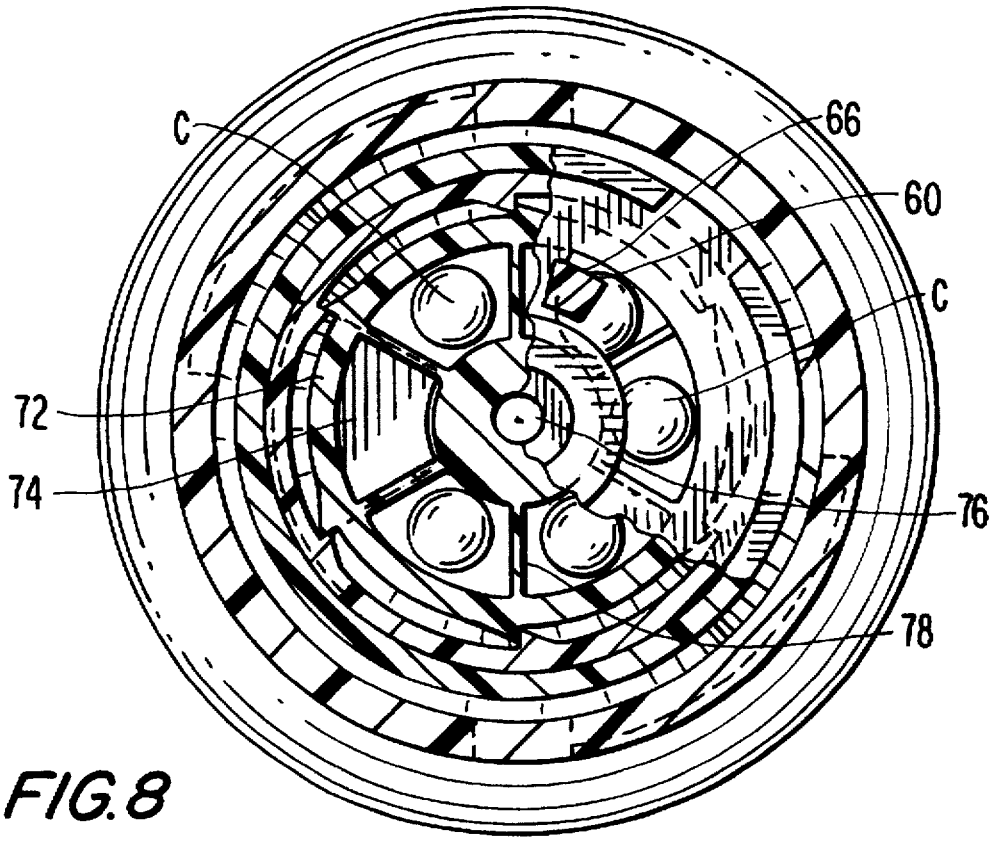
FIG. 8 is a cross-sectional view of the invention with capsules in the pie-shaped chambers, with the view being taken along lines 8—8 of FIG. 7.

Together, the basic components of the present invention comprise a bottle, the cap, the holding plate and the wheel-like component. To enable an understanding of the operation of the device, its basic method of use will now be described. The details of the individual components will be more fully described hereinafter. First, assuming that the device is in its child proof or locked position, the user will rotate the ring segment 32 so that its opening is aligned with the tab 38 of the cap's door 34. In this position, the door 34 can be lifted about the plastic hinge 36 to reveal the cap's opening 42. An annular segment, secured to the top of the door, not only prevents the child proof ring segment 32 from becoming dislodged but also serves as the means to capture and hold the door in the open position. The annular segment is secured into a pair of opposed notches, located in the cap's top surface. In this position the container is in its unlocked position, ready to dispense capsules C, one at a time. Then, with the container inverted, as shown in FIG. 7, the user holds the bottle 12 with one hand and the cap 30 with the other. Rotation of the cap with respect to the bottle, first about a one-quarter turn counterclockwise (holding the bottle still) and then a one-quarter turn clockwise (again, holding the bottle still) will cause a capsule C to pass from a pie-shaped holding chamber 74 of the wheel-like component 70 through the single capsule hole 52 in the holding plate 50 and then through the opening 42 in the cap 30, into the user's hand.

Thus, a single capsule C has been dispensed. At the same time, rotation of the wheel-like component rotates the sweeping blades, within the bottle, which mixes up the capsules within the bottle and causes another capsule C to fall into and enter the now-emptied pie-shaped chamber. When one or more capsules have been dispensed, each time requiring a one-quarter turn of the cap with respect to the bottle in a first direction followed by a one-quarter turn of the cap with respect to the bottle in the second opposite direction, the bottle can be closed by moving the tab 38 of the cap from its locked open position back to its closed position. Then, the child proof ring segment 32 is rotated so that it overlaps the tab 38 of the door. In this condition the cap is sealed and substantially child-proof, thereby precluding children from dispensing capsules.

The specific mechanical and functional details of the components of the capsule storage and dispenser will now be further explained:

A) The Cap

The cap 30 is basically cylindrical with a sidewall 41 having a slot 40 cut therein. A ridge 43 extends radially inward from the outside lip 45 extending from the sidewall 41. A locking mechanism, for child proofing the dispenser, is provided. A ring segment 32 is provided. The ring segment 32 extends about 180 degrees (preferably the ends of the ring segment 32 are tapered) and has its radius of curvature about that of the inside surface defined by the inside of the cylindrical sidewall 41 of the cap. Thus, the ring segment can rotate, below the ridge 43, along the inside of the sidewall 41. When the ring segment 32 overlays the tab 38 of the hinged door 34, then the tab cannot be lifted. When the opening of the ring segment 32 overlays the tab 38 of the hinged door 34, then the door can be opened. Of course, it should be apparent, that the circumferential length of the ringed segment must be sufficient so that it extends beneath the two edges of the ridge 43 when the device is to be locked and child proofed. A tab 47 of the ring segment 32 facilitates the selective rotation of the ring segment from its locked to its unlocked position, and vice versa.

The door 34 of the cap 30 is opened by lifting of the tab 38. As mentioned, the lifting can only be done when the ring segment is not blocking the movement, i.e., when the opening of the ring segment overlays the tab 38. Secured to the top surface of the door is a door securing device. The door securing device, in its preferred form, is a small arcuate section 90. This arcuate section serves several functions: first, it maintains the ring segment 32 in place, i.e., it ensures that the ring segment rotates and slides against the inside cylindrical wall of the cap as the tab 47 is rotated. The arcuate section 90 also prevents the ring segment 32 from accidentally or intentionally being removed from the cap. Additionally, the arcuate section 90 serves to hold the door 34 in its opened position by cooperating with opposed notches 94, located in the ridge 43. The circumferential length of the arcuate section 90 is about that of the distance between the notches 94 of the ridge 43 so that the door will be held in location by the mechanical cooperation of the arcuate section and the notches. This feature is enhanced by the resiliency of the arcuate section such that it flexes into the notches for capture and is held there until the tab of the door is moved to shut the door of the device. Opening of the door and securing the arcuate section 90 into the notches 94 reveals cap opening 42. It is through this opening 42 that a capsule C will pass when the device is manually manipulated, as described.

Turning to FIG. 12, the bottom of the cap 30, there is shown a pawl 60 which extends downwardly toward the interior of the bottle 12. The pawl is finger-like and passes through the holding plate, specifically through the larger arcuate segment or window 54 of the holding plate 50, so as to turn the capsule holding chambers 74, one at a time, into alignment with the single capsule hole 52 of the holding plate 50, to dispense capsules C. The pawl has a vertical planar surface 61 which contacts a wall 78 of the chambers 74 when the cap 30 is rotated in a first direction with respect to the bottle 12. The pawl has a sloped or inclined surface 66. The sloped or inclined surface 66 cams over the top edge of the holding chambers as the cap is rotated in the reverse direction.

A downwardly extending tab 96 serves to mechanically limit the rotation of the cap 30 with respect to the bottle. The outside of the neck portion 14 of the bottle 12 is provided with abutment ledges 98 and 100 to limit the rotation of the cap. More specifically, the cap is limited in its rotation since the tab 96 can only travel between abutment ledge 98 and 100. In an alternate embodiment of the present invention, the cap is provided with a second downwardly extending tab and a second set of abutment ledges to limit the movement of the cap on the bottle.

Sidewall 41 of the cap 30 is provided with a visual indicating protrusion 104 (a differently colored plastic tab) which when mated with a visual indicator (not shown) of the neck portion 14 of the bottle allows the cap to be removed from the bottle. When the protrusion is aligned with the indicator, preferably aligning of arrows, the inwardly directed tab of the protrusion is aligned with an opening in the threads of the neck portion. When the protrusion and its inwardly directed tab are out of alignment with the visual indicator 106 of the neck portion, the inwardly directed tab blocks removal of the cap since the threads of the neck portion of the bottle overlay the inwardly directed tab.

B) The Holding Plate

The holding plate 50 is basically a flat cylindrical section having an attached side flange 62 and a ceiling 64. The flat cylindrical section 108 (See FIGS. 11 and 13) is provided with one or more (preferably four) tabs 110 which mate with recesses 112 in the neck portion 14 of the bottle 12. The mechanical mating of the tabs within the recesses 112 of the bottle 12 locate the holding plate and prevent it from rotating with respect to the bottle. Rather rotation of the bottle will carry along with it rotation of the holding plate. The cylindrical section 108 of the holding plate is provided with an arc-shaped hole 52 which is large enough to allow a capsule C to pass therethrough. Indeed, the size of the hole 52 is substantially the same as the size of the pie-shaped capsule holding chambers 74 of the wheel-like component. Located across yet offset by 45 degrees from the center of the hole 52 is the larger arcuate segment or window 54. As previously mentioned, the window 54 provides access by the pawl 60 to the side walls 78 of the capsule holding chambers 74 such that rotation of the cap, rotating the pawl, causes the wheel-like component 70 to rotate. The center of the cylindrical section 108 of the holding plate is provided with a small hole 114 which accepts a small circular axis plug 1 16 serving as the shaft or axis of rotation of the wheel-like component 70. The axis plug passes through the center of the cylindrical section 108 and is frictionally or otherwise gripped by the hole 114 of the holding plate. The free end of the axis plug provides a rod-like protrusion for the wheel-like component to rotate about.

The lip 120 of the holding plate 50 extends toward the bottle 12. Extending inwardly from the lip 120 is a locking tooth 122 (See FIG. 9). The locking tooth cooperates with the ratchet teeth 130 of the wheel-like component 70. As a consequence of the geometry of the ratchet teeth 130 and the locking tooth 122, the wheel-like component 70 can rotate in one direction with respect to the holding plate but cannot be rotated in the opposite direction. There are, in the preferred embodiment of the present invention, six ratchet teeth, corresponding to the number of holding chambers 74. The location of the locking tooth around the inside circumference of the lip 120 of the holding plate 70 is arbitrary but is designed such that there is alignment between the chambers 74 and the hole 52 of the holding plate. As the wheel-like component is rotated with respect to the bottle, via the rotation of the cap and the pawl acting on a wall of a holding chamber, the ratchet teeth will glide over the locking tooth. Reverse rotation is blocked by the mechanical engagement of a ratchet tooth with the surface of the locking tooth.

The ceiling 64 of the holding plate serves two basic purposes, namely, it ensures that only one capsule is dispensed per rotation and, in addition, the ceiling pushes the capsule that is inside the chamber outward (out of the bottle) while, at the same time, pushing a capsule, not yet located in a chamber, away from the then-dispensing chamber. Thus the ceiling serves to separate the capsules as they are ready, one by one, to be dispensed through the hole of the holding plate.

C) The Wheel-like Component

The wheel-like component 70 is basically cylindrical. An outside circumferential wall 72 fits within the lip 120 of the holding plate. A series of walls 78, radially extending outward from the center hub 76 of the component divides the device into a plurality of capsule holding chambers 74. In the preferred embodiment, each of the holding chambers is just sized so as to be capable of holding a single capsule C. In the preferred embodiment of the present invention, six holding chambers are provided. The holding chambers are defined by a pair of radially extending walls 78, an outside arcuate section 140 and an inside arcuate section 142 (See FIG. 9). The center hub 76, as mentioned, rotates about the axis plug 116.

The outside circumferential wall 72 of the component 70 is provided with a plurality of equally spaced ratchet teeth 130. These cooperate in a many previously described with the locking tooth 122 of the holding plate to allow relative rotation in a first direction of the wheel-like component in one direction but no rotation of the wheel-like component with respect to the holding plate in the reverse direction.

The center hub 76 of the wheel-like component extends as a hollow axle 144 (See FIG. 11) along the center axis of the bottle 12. The hollow axle 144 carries two or more, preferable three, equidistant sweeping arms 150. The sweeping arms 150 are basically triangular and have their base substantially parallel to the top surface of the ceiling 64, to sweep capsules away from the ceiling so as to prevent more than one capsule from entering the holding chamber beneath the ceiling. This is intended to prevent jamming and clogging. The sweeping arms also serve to mix up the contents of the bottle so that, as capsules are dispensed, the remaining capsules may fall into the empty, if any, chambers of the wheel-like component. Three collar segments 148 are secured to the outside of the hollow axle 144, in between the sweeping arms 150, to maintain the ceiling 64 and the sweeping arms 150 in their proper orientation and positions.

Secured to the outside of the hollow axle 144, toward the bottle 12, are a plurality of flexible finger elements 152. These can be secured to the hollow axle by having holes of the finger elements pass over bosses of the hollow axle. The flexible finger elements 152 have, at their distal ends, inwardly directed tips 154. Selectively secured to the wheel-like component is a moisture absorbent canister 160. The canister is cylindrical and fits between the finger elements. An annular ridge 162 of the canister is grabbed by the inwardly directed tips 154 of the finger elements. The canister is held by the finger elements, away from the sweeping arms 150 and the holding chambers 74, so as to not interfere with their operation.

D) The Bottle

The bottle 12 is basically cylindrical and comprises a substantially cylindrical sidewall 18, a bottom 16 and a neck portion 14. The neck portion 14 defines a mouth 20. The wheel-like component 70, with canister 160, and holding plate 50 are centrally secured to the bottle. The holding plate is provided with tabs 110 which cooperate with recesses 112 in the neck portion for securing the holding plate in position such that rotation of the bottle causes the holding plate to rotate. The neck portion of the bottle is provided with an outwardly extending lip 170 which does not extend fully around the neck portion but, rather, terminates in a pair of abutment ledges 98 and 100. The downwardly extending tab 96 of the cap fits between the abutment ledges. The rotation of the cap is limited, therefore, by the range of motion allowed by the tab 96 moving between the abutment ledges.

In Operation a) The Child Proof Mechanism

Assuming the capsule storage device and dispenser is sold in the child proof condition, it will be necessary, prior to dispensing a capsule C, to disable or unlock the child proof mechanism. For a child, this will be difficult. For an adult, rather easy. Basically, the tab 47 of the ring segment 32 must be rotated so that the opening in the ring segment overlays the tab 38 of the door. In this position, the tab 38 of the door 34 can be lifted to provide access to the capsule dispensing mechanism. If the ring segment overlays the tab 38 of the door 34, then the tab of the door cannot be lifted and the device is substantially child proof since the opening providing a means for escape of a capsule is blocked.

The door of the device can be maintained in its open position by the frictional engagement of the small arcuate section 90 of the cap with the notches 94 of the cap.

If, on the other hand, the device has already been used to dispense a capsule, and the user desires to implement the child proof aspects of the dispenser, then rotation of the ring segment by rotation of the tab 47 such that the ring segment overlays the tab 38 of the door 34 is necessary. To ensure the reliability of the child proof mechanism, the ring segment should extend across the slot 40 of the sidewall 41 of the cap. This will ensure that the door cannot be opened.

b) Dispensing Capsules

With the child proof mechanism disabled and the door open, the device can be used to individually dispense capsules. The user will invert the bottle so that the bottom 16 is on top and the mouth 20 of the bottle projects downwardly. Then, the user will hold the bottle with one hand and rotate the cap 30 with the other hand. The cap will rotate until its tab 96 is prevented from further movement by contact with the abutment ledge 100. Rotation of the cap causes the pawl 60 of the cap to rotate. The pawl extends through the arcuate segment or window 54 of the holding plate and is in mechanical contact with one wall of a capsule holding chamber. The pawl 60 will contact one of the walls 78 of the capsule holding chambers and will rotate the wheel-like component as the cap rotates. Rotation of the cap in a counterclockwise manner with respect to the bottle. This, of course, rotates a capsule holding chamber and capsule C. Then, rotation of the cap in the reverse or clockwise direction with respect to the bottle causes a chamber with capsule to pass below the ceiling of the holding plate and the capsule and holding chamber for the same is then aligned with the small hole 52 of the holding plate and the opening 42 provided by hinged movement of the door to its unlocked position. The capsule is thus dispensed, aided by the ceiling pushing on the back end of the capsule through the hole 52, into the user's hand. The action is facilitated, too, by gravity. Rotation of the wheel-like component causes the sweeper arms to rotate, mixing up the contents of the remaining capsules and placing a capsule into the chamber which was, prior to turning of the cap, beneath the ceiling of the holding plate. Rotation of the cap with respect to the bottle causes a holding chamber with a capsule to be placed into alignment with the hole 52 of the holding plate such that a capsule can be dispensed. In addition, the rotation of the cap with respect to the bottle causes additional pills to fill up the chambers which were emptied by formerly being in alignment with the hole 52. The pawl 60 causes the wheel-like component to rotate and its sloped surface acts as a one way ratchet allowing the one directional movement of the chambers as the cap is rotated. Also, as mentioned the interaction of the ratchet teeth of the wheel-like component and the holding plate ensures that the capsule holding chambers move in the proper direction, only.

When the proper number of capsules have been dispensed, the device can be placed with its bottom 16 down. Then, if desired, the door can be shut by disengaging the small arcuate section 90 from the notches, allowing the door to be rotated, about hinge 36, accomplished by manipulation of the tab 38, until the tab is in the slot 40 of the cap. Then, if desired the child proof mechanism can be engaged, as well.

The relative rotation of the cap to the bottle facilitates mixing of the capsules such that they are more likely to fall into empty chambers. This is accomplished by the sweeping blades pushing the contained-capsules downwardly, i.e., towards the cap as the cap is relatively rotated. Also, the mixing motion of the sweeping blades ensures that capsules are being presented to the empty chambers in a wide variety of orientations such that if a capsule has not yet fallen into an empty chamber, after mixing by the sweeping blades, a capsule, in a slightly different orientation, may fall into the chamber. Also, the second stroke of the relative rotation of the cap to the bottle causes the pawl of the cap to slide under the wheel-like component. When the end of the cycle is reached, the pawl allows the holding plate to shift back to its original horizontal position (it was deflected from horizontal by the incline of the pawl acting on the wheel-like component) which sudden shifting to horizontal causes some additional shifting/mixing of the capsules.

The sweeping blades provide an irregular surface such that the capsules within the bottle must fall or "teeter", like a see-saw, into a vertical position. This facilitates the location and placement of capsules into the chambers. Stated another way, if the capsules within the bottle are aligned basically horizontally, than, as the sweeping blades cause mixing (by rotation of the cap relative to the bottle) the capsules are tilted with one or the other of its ends downwardly, i.e., into a more vertical position. This ensures that the capsules will fall into the empty chamber.

Although particular embodiments of the present invention have been shown and described, modification may be made to the package without departing from the teachings of the present invention. Accordingly, the present invention comprises all embodiments within the scope of the appended claims.

What we claim is as:

1. A one at a time capsule storage and dispenser device comprising:

a) a bottle portion for holding capsules having a neck portion;

b) a cap secured to said neck portion and capable of relative rotational motion with respect to said bottle portion, said cap having an opening, said cap being provided with a downwardly extending pawl means;

c) a holding plate secured to said bottle having an opening only slightly larger than the size of the capsules to be dispensed by said device and an arcuate window, said pawl means extending through said window and capable of rotational movement within said window when said cap is rotated with respect to said bottle; and d) a wheel-like component comprised of a plurality of capsule holding chambers and capable of rotation along with rotation of said cap by the mechanical interengagement of said pawl means with one of said capsule holding chambers such that rotation of said cap causes one of said capsule holding chambers to become aligned with said hole of said holding plate to allow a capsule to be dispensed.

2. A device as claimed in claim 1 wherein said cap comprises a door hinged to the top surface of said cap.

3. A device as claimed in claim 2 wherein said cap is further provided with child proof means to prevent said door from being opened unless said child proof means is first disabled.

4. A device as claimed in claim 3 wherein said child proof means comprises a ring segment which is rotatable to overlay said door to block access to the contents of the device and rotatable so as not to overlay said door to allow said door to be opened to provide access to the contents of said device.

5. A device as claimed in claim 2 further comprising a door holding means for holding said door in the open position, said door holding means comprising an arcuate section on said door which frictional engages a pair of opposed notches of said cap.

6. A device as claimed in claim 5 further comprising a child proof mechanism comprising a ring segment which is rotatable to overlay said door to block access to the contents of said device and rotatable so as not to overlay said door to allow said door to be opened to provide access to the contents of said device, said arcuate section also serving to prevent said ring segment from being removed from said cap.

7. A device as claimed in claim 1 wherein said cap is provided with child proof means.

8. A device as claimed in claim 1 wherein said holding plate is provided with a ceiling matching the dimensions of one of said capsule holding chambers.

9. A device as claimed in claim 1 wherein said holding plate is provided with a ceiling which directs a capsule from said capsule holding chamber, through said hole in said holding plate, when said cap is rotated with respect to said bottle.

10. A device as claimed in claim 1 wherein said holding plate is provided with a locking tooth and said wheel-like component is provided with two or more ratchet teeth for ensuring one-way rotation of said wheel-like component with respect to said bottle, even if said bottle is rotated in two directions of rotation.

11. A device as claimed in claim 1 wherein said pawl means rotates said capsule holding chambers in a first direction of rotation when said cap is rotated with respect to said bottle in said first direction of rotation and said pawl means cams over said capsule holding chambers when said cap is rotated in a second, opposite direction of rotation with respect to said bottle.

12. A device as claimed in claim 1 wherein said wheel-like component is provided with at least one sweeping arm for agitating the capsules contained within the bottle during rotation of said cap with respect to said bottle.

13. A device as claimed in claim 1 further comprising a moisture absorbent canister.

14. A device as claimed in claim 13 wherein said moisture absorbent canister is secured to said wheel-like component.

15. A device as claimed in claim 1 wherein the movement of said pawl with respect to said holding plate and wheel-like component causes a vibration to capsules contained in said bottle.

* * * * *